US006307623B1

(12) United States Patent
Papuchon et al.

(10) Patent No.: US 6,307,623 B1
(45) Date of Patent: Oct. 23, 2001

(54) DEVICE FOR HARMONIZING A LASER EMISSION PATH WITH A PASSIVE OBSERVATION PATH

(75) Inventors: Michel Papuchon, Villebon S/Yvette; Denis Rabault, Boulogne Billancourt; Martin Defour, Croissy S/Seine; Jean-Paul Pocholle, La Norville, all of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/413,643

(22) Filed: Oct. 6, 1999

(30) Foreign Application Priority Data

Oct. 6, 1998 (FR) ..... 98 12498

(51) Int. Cl.[7] ..... G01B 11/26

(52) U.S. Cl. ..... 356/152.1; 356/153

(58) Field of Search ..... 356/152.1, 141.1, 356/153; 250/342

(56) References Cited

U.S. PATENT DOCUMENTS

| | | |
|---|---|---|
| 3,832,567 | 8/1974 | Jacques et al. . |
| 3,977,763 | 8/1976 | Ostrowsky et al. . |
| 4,035,058 | 7/1977 | Papuchon . |
| 4,077,113 | 3/1978 | Papuchon . |
| 4,196,964 | 4/1980 | Papuchon . |
| 4,198,116 | 4/1980 | Papuchon . |
| 4,203,649 | 5/1980 | Valasco et al. . |
| 4,223,977 | 9/1980 | Papuchon et al. . |
| 4,236,785 | 12/1980 | Papuchon et al. . |
| 4,252,402 | 2/1981 | Puech et al. . |
| 4,265,541 | 5/1981 | Leclerc et al. . |
| 4,288,785 | 9/1981 | Papuchon et al. . |
| 4,309,667 | 1/1982 | Di Forte et al. . |
| 4,320,475 | 3/1982 | Leclerc et al. . |
| 4,340,272 | 7/1982 | Papuchon et al. . |
| 4,370,612 | 1/1983 | Puech et al. . |

(List continued on next page.)

FOREIGN PATENT DOCUMENTS

| | | |
|---|---|---|
| 0 451 017 | 10/1991 | (EP) . |
| 2 669 427 | 5/1992 | (FR) . |
| 2 165 957 | 4/1966 | (GB) . |
| 9/27108 | 11/1994 | (WO) . |

* cited by examiner

*Primary Examiner*—Stephen C. Buczinski
(74) *Attorney, Agent, or Firm*—Oblon, Spivak, McClelland, Maier & Neustadt, P.C.

(57) ABSTRACT

A device for harmonizing a laser beam path with an observation path for a target includes a laser that generates a laser beam; a first optical element that directs a first part of the laser beam toward the target along the laser beam path while directing a second part of the laser beam toward a conversion device; and a second optical element that directs a converted beam from the conversion device to a sensor that receives the converted beam and an image from the target. The conversion device includes a photoluminescent material that converts the second part of the laser beam into a converted radiation having a wavelength within a spectral band of the sensor, and an optical assembly that focuses the second part of the laser beam into the photoluminescent material and that collects at least a portion of the converted radiation to form the converted beam. The photoluminescent material can include photoluminescent ions such as erbium ions, or a semiconductor material such as indium arsenide. The photoluminescent material can include two materials, wherein the first material has a photoluminescence lifetime greater than a pulse duration of the pulsed laser beam, and the second material has an emission spectrum of photoluminescence covering at least a portion of a sensitivity spectral band of the sensor. The conversion device can also include a non-linear material that frequency converts the second part of the laser beam into an intermediary radiation having a wavelength shorter than the laser beam, and where the photoluminescent material converts the intermediary radiation into the converted radiation.

23 Claims, 4 Drawing Sheets

U.S. PATENT DOCUMENTS 4,391,486 7/1983 Papuchon et al. .
4,422,758 12/1983 Godfrey et al. .
4,427,260 1/1984 Puech et al. .
4,433,895 2/1984 Puech et al. .
4,468,085 8/1984 Papuchon et al. .
4,480,915 11/1984 Arditty et al. .
4,482,248 11/1984 Papuchon et al. .
4,560,867 12/1985 Papuchon et al. .
4,571,080 2/1986 Papuchon et al. .
4,583,817 4/1986 Papuchon .
4,732,444 3/1988 Papuchon et al. .
4,763,972 8/1988 Papuchon et al. .
4,778,234 10/1988 Papuchon et al. .
4,794,045 12/1988 Robin et al. .
4,880,288 11/1989 Vatoux et al. .
4,897,699 1/1990 Raxeghi et al. .
4,901,321 2/1990 Blondeau et al. .
4,906,949 3/1990 Pocholle et al. .
4,917,450 4/1990 Pocholle et al. .
4,927,223 5/1990 Pocholle et al. .
4,927,245 5/1990 Papuchon et al. .
4,943,144 7/1990 Delacourt et al. .
4,969,701 11/1990 Papuchon et al. .
5,012,476 4/1991 Razeghi et al. .
5,047,638 9/1991 Cameron et al. .
5,052,770 10/1991 Papuchon .
5,055,422 10/1991 Weisbuch et al. .
5,056,919 10/1991 Arditty et al. .
5,077,466 12/1991 Delacourt et al. .
5,077,750 12/1991 Pocholle et al. .
5,086,433 2/1992 Pocholle et al. .
5,088,096 2/1992 Pocholle et al. .
5,105,428 4/1992 Pocholle et al. .
5,123,025 6/1992 Papuchon et al. .
5,128,948 7/1992 Papuchon et al. .
5,134,681 7/1992 Ratovelomanana et al. .
5,138,628 8/1992 Pocholle et al. .
5,160,991 11/1992 Delacourt et al. .
5,173,910 12/1992 Pocholle et al. .
5,206,674 4/1993 Puech et al. .
5,222,093 6/1993 Pocholle et al. .
5,243,617 9/1993 Pocholle et al. .
5,247,168 9/1993 Pocholle et al. .
5,249,075 9/1993 Delacourt et al. .
5,251,003 * 10/1993 Vigouroux et al. .
5,282,073 1/1994 Defour et al. .
5,289,309 2/1994 Delacourt et al. .
5,291,196 3/1994 Defour .
5,311,221 5/1994 Vodjdani et al. .
5,311,540 5/1994 Pocholle et al. .
5,321,489 6/1994 Defour et al. .
5,323,372 6/1994 Puech et al. .
5,349,466 9/1994 Delacourt et al. .
5,355,000 10/1994 Delacourt et al. .
5,359,403 10/1994 Grosmann et al. .
5,369,524 11/1994 Pocholle et al. .
5,375,131 12/1994 Pocholle et al. .
5,384,801 1/1995 Pocholle et al. .
5,432,634 7/1995 Dupont et al. .
5,444,571 8/1995 Debuisschert et al. .
5,570,387 10/1996 Carriere et al. .
5,610,759 3/1997 Delacourt et al. .
5,615,042 3/1997 Delacourt et al. .
5,748,362 5/1998 Delacourt et al. .
5,786,889 * 7/1998 Pope et al. ..... 356/152.1
5,835,258 11/1998 Papuchon et al. .
5,912,455 6/1999 Pocholle et al. .

* cited by examiner-

FIG. 3
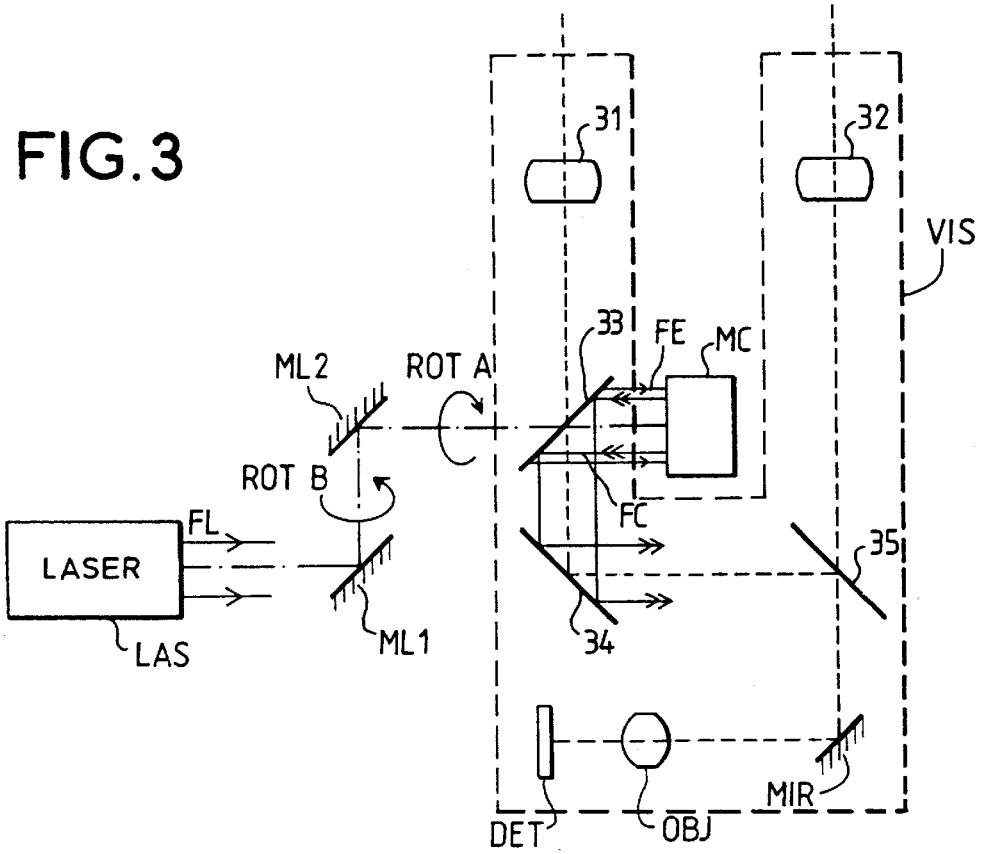
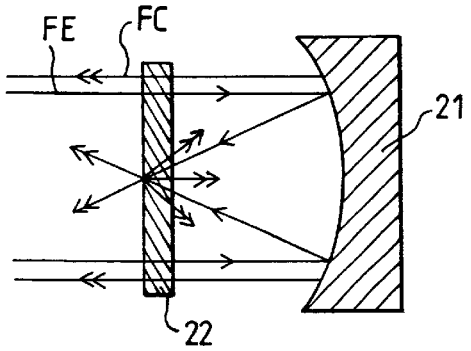
FIG. 4
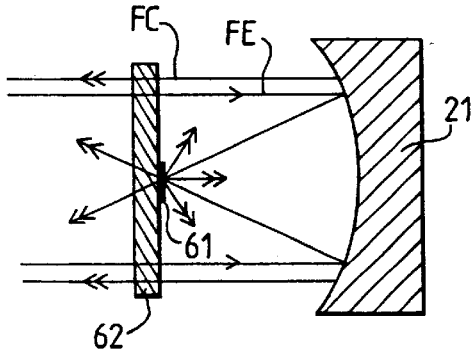
FIG. 6

DEVICE FOR HARMONIZING A LASER EMISSION PATH WITH A PASSIVE OBSERVATION PATH

BACKGROUND OF THE INVENTION

1. Field of the Invention

The invention relates to a device for harmonization between a laser emission path and a passive observation path, the optical paths having axes that may be separate or the same. The harmonizing consists in making the optical axes of these paths parallel so that they have a common line of sight. The invention can be applied especially to target designation systems comprising a laser path and a passive observation path or the imager or offset measurement device type. It can be applied also to active/passive imaging systems comprising a scanning laser emission path and a passive imaging path. More generally, it can be applied to any system where the laser emission path and the passive observation path have to be harmonized.

2. Description of the Prior Art

In harsh environmental conditions, especially in terms of temperature and vibration, target designation by laser is advantageously done by means of a <<pod >> arranged for external carriage in the aircraft. It may have an imaging path with band II or band III infrared detection, enabling the location of a target and a laser path whose optical axis may be separate or the same as that of the imaging path. This laser path has emission for example in the near infrared and is 'locked' into the imaging path. This locking implies perfect "alignment" between the two paths. In other words, it implies perfect parallelism between their optical axes (whether or not these axes are one and the same axis). These optical axes then define one and the same line of sight. It should be possible to monitor this harmonizing during a mission.

If the emission wavelength of the laser is not included in the spectral band of the sensor of the imaging path or if the laser should send pulses that are too short to be detected by the sensor, it is not possible to harmonize the paths by taking a fraction of the laser beam and reflecting it to the sensor in order to determine the offset between the spot formed by the laser on the sensor and the center of the sensor.

The French patent application No. 2 669427 describes a device to monitor the alignment of a laser beam sighting path and an infrared imaging path, for example in a laser designation pod. This device consists of a housing comprising a cassette containing a polyimide film and means for advancing this film. During the harmonizing procedure, the laser beam is focused on the film which gets heated up, thus generating a hot point displayed on the infrared detector. This enables a measurement of the alignment offset between the two paths. In order to be visible in the band II or III, the heating must be substantial and lead to the local destruction of the film. This explains the film advancing means that have been installed. The housing is bulky and the solution described does not enable the harmonizing to be done during the operations of designation. Nor does it permit the harmonizing to be done for operational lines of sight, especially when the system provides for a possible deflection of the line of sight.

The device according to the invention overcomes these drawbacks by implementing means of conversion by which it is possible, for example from a fraction of the incident laser beam, to obtain a beam that is detectable by the detector of the passive path. These means are based on the photoluminescence properties of certain materials.

SUMMARY OF THE INVENTION

More specifically, the invention relates to a device for harmonization between a emission path comprising a laser emitting a laser beam and a passive observation path comprising a sensor, the device comprising means for the conversion of an incident light beam into a back-propagating beam. The device comprises optical means enabling the simultaneous sending, towards the emission path, of almost the totality of the laser beam and, towards the conversion means, of an excitation beam forming the incident beam and having its direction of propagation and its divergence related to the direction or propagation and divergence of the laser beam emitted to the conversion means, the conversion means comprise a photoluminescent material which, when excited at the wavelength of the excitation beam, emits a radiation whose wavelength is contained in the spectral band of the sensor of the observation path as well as an optical assembly enabling the excitation beam to be focused in the photoluminescent material and enabling the collection of at least a part of the emitted radiation to form the back-propagating beam. The device furthermore comprises means to send the back-propagating beam to the sensor, thus enabling the real-time identification of the defects of harmonization.

Advantageously, the excitation beam is simply a fraction of the laser beam of the emission path that is sufficient to make the conversion. The conversion means of the device according to the invention are compact and enable great flexibility in the implementation of the harmonizing procedures. Furthermore, the very great variety of photoluminescent materials in terms of the emission spectral band and emission lifetime makes it possible to match the conversion means with the characteristics of the sensor of the passive observation path.

BRIEF DESCRIPTION OF THE DRAWINGS

Other advantages and characteristics of the invention shall appear more clearly from the following description made with reference to the appended figures, of which:

FIG. 3 shows an alternative embodiment of a system implementing the device according to the invention;

FIG. 4 is a drawing illustrating an exemplary embodiment of the conversion means in the device according to the invention;

FIG. 6 is a drawing illustrating another exemplary embodiment of the conversion means;

MORE DETAILED DESCRIPTION

Figure 1:
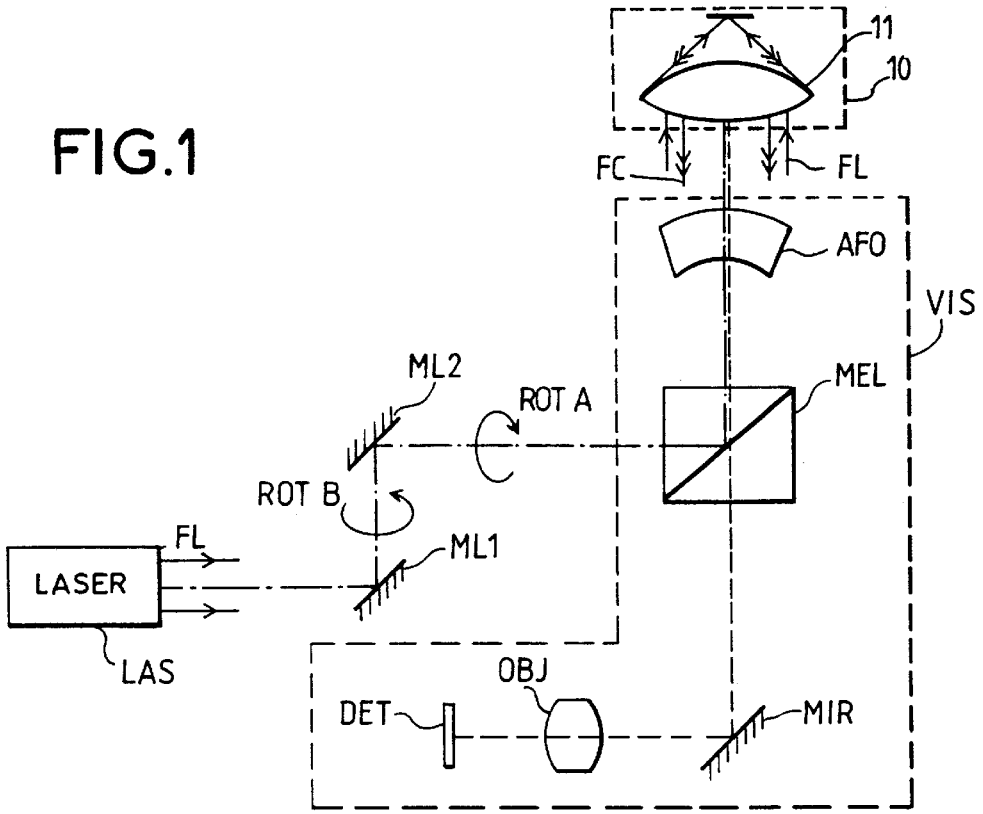
FIG. 1 is a drawing of a system of target designation by laser guidance with a harmonizing device according to the prior art.

FIG. 1 shows a layout diagram of a harmonizing device according to the prior art described in the patent referred to here above in a pod type system of target designation by laser guidance. The system considered here has a emission path comprising a laser LAS emitting a laser beam FL whose optical axis is represented by dots and dashes in FIG. 1. The laser LAS is for example a Nd:YAG type pulsed laser emitting pulses of some tens of nanoseconds at 1.60 μm for the designation functions and/or telemetry functions. In this example, the laser beam FL is substantially collimated. The system also has a passive observation path whose optical axis is shown in dashes in FIG. 1. This passive observation path comprises an objective OBJ and a detector DET, sensitive for example in the infrared, in the 3–5 μm band or 8–12 μm band. The detector may be an imager of the heat camera type or it may be an offset measurement device for example in the case of the designation of a target illuminated by an auxiliary light beam. In the exemplary designation system chosen, the optical axes of the two paths are superimposed by means of a mixer MEL, for example a dichroic cube reflecting almost all the laser emission flux and transmitting all the incident infrared flux. However, the two paths could be distinct, with parallel optical axes. In both cases, the line of sight is common to both two paths. As in the example shown in FIG. 1, there may be a possibility of play, enabling the exploration of a wide field by means of two rotations indicated ROT A and ROT B around two perpendicular axis of rotation. To maintain the alignment between the two paths whatever the position of the line of sight, a set of two mirrors ML1 and ML2 for the alignment of the laser beam (FL) is used. This set of mirrors defines the two axes around which the rotations are made. The system also has an afocal device AFO common to the two paths in the example shown in FIG. 1, enabling the lengthening of the laser beam (FL) of the emission path and the collection of the flux emitted by a scene to be observed. The assembly comprising especially the afocal device, the mixer MEL, the objective OBJ and the sensor DET of the passive observation path forms the optical sighting head VIS which is movable around the rotational axes ROT A and ROT B, the different elements of the sighting head being mechanically fixed together.

In this type of system, it is necessary to have perfect harmonization between the laser emission path and the passive observation path, namely a perfect alignment of their optical axes. Harsh environmental conditions (in terms of temperature, vibration, etc. may lead to defects of harmonization due for example to the appearance of mechanical imprecision in the rotation of the sighting head. It is therefore necessary to be able to monitor the harmonization during a mission. It may be noted that this constraint on the harmonization of the two paths is applicable to many other optronic systems: for example, a missile jamming device comprising a "jamming" laser and an offset measurement device to identify the hot point constituted by the missile or an active/passive imaging device in which the center of the "active" image obtained with a laser scanning the scene must be harmonized with the center of the "passive" image obtained for example by means of a thermal camera. FIG. 1 illustrates an example of the setting up of a prior art harmonizing device that that can be applied to a system in which the detector DET of the observation path is sensitive in the infrared range. It is assumed that the emission laser emits in the visible or near infrared range and that it cannot be detected by the detector DET. The prior art device has a housing 10 in which there is a polyimide film 12 and means for advancing this film that are not shown. An optical assembly 11 enables the incident laser beam FL to be focused on the film which absorbs the incident flux and gets heated, and enables the collimation of the thermal flux emitted by the film to form a beam FC parallel to the incident beam FL. The heat emission is done in the infrared and can therefore be displayed by the detector of the observation path, thus enabling an identification on the harmonizing defects. These defects are then corrected, for example by activating a mirror MIR for the adjustment of the infrared imaging path or by the processing of the acquired images, the reference point in the image being modified. However, the prior art device, which requires a complex mechanical system to make the film run, is bulky and requires almost all the power of the laser of the emission path. It is generally fixed to the structure of the 'pod' in such a way that, to obtain the harmonization procedure, the optical sighting head VIS is turned back so as to be facing the harmonization device as is shown in FIG. 1. The harmonization procedure therefore requires an interruption of the image-taking process. This procedure can be done only along a line of sight which furthermore is not operational.

Figure 2:
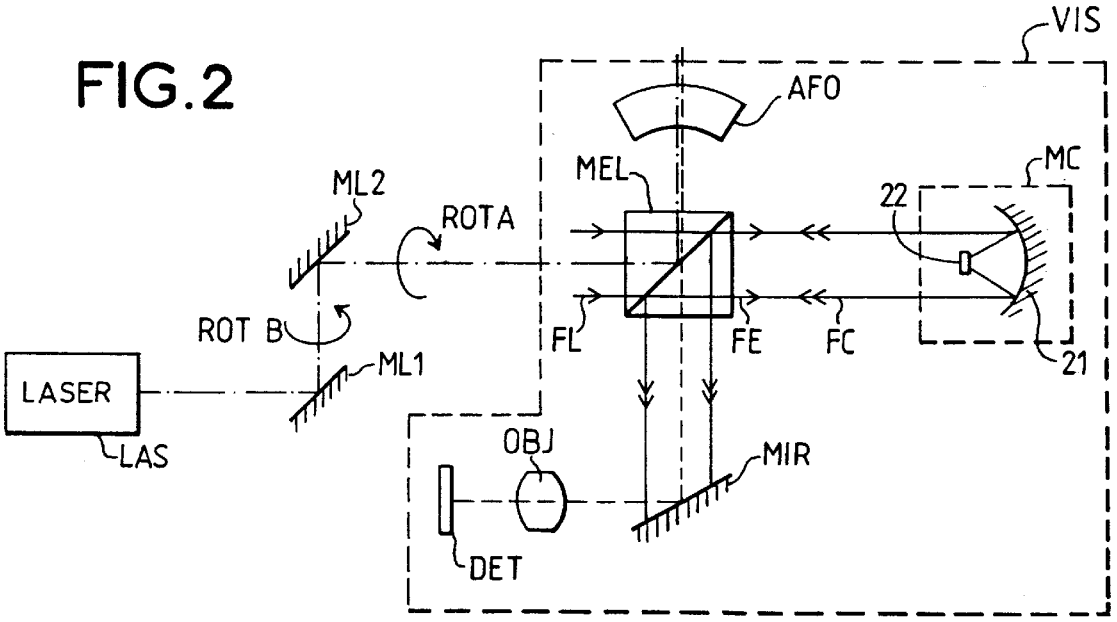
FIG. 2 is a drawing of a same system with a device for the harmonizing of the two paths according to the invention.

An exemplary embodiment of the device according to the invention and its implementation is shown schematically in FIG. 2. The target designation system chosen to illustrate the harmonization device is the same as that of FIG. 1. In particular, the laser beam of the emission path is substantially collimated and the optical axes of the two paths are superimposed by means of the mixer MEL, which is for example a dichroic cube.

The device according to the invention has conversion means MC comprising a photoluminescent material which, when excited at the wavelength of an excitation beam whose direction of propagation and divergence are related to the direction of propagation and divergence of the emission laser beam, emits a radiation whose wavelength is within in the spectral band of the sensor of the observation path. The photoluminescence results from the interaction between a material and an external light source. In the photoluminescent material, the atoms, after the absorption of a photon, are excited at a higher energy level and relax spontaneously towards a lower energy level emitting a photon in the process. The wavelength of the emitted photon is greater than that of the absorbed photon. When the transitions are permitted, namely when they are done with high probability of occurrence (singlet-singlet or triplet-triplet transitions), the term 'fluorescence' is used. The term 'phosphorescence' is used when the transitions are forbidden, i.e. when they are made with a very low probability of occurrence and therefore have long emission times (triplet-singlet transitions for example). Examples of photoluminescent materials will be given hereinafter in the description.

In the example of FIG. 2, the excitation beam FE is simply a fraction of the laser beam (FL) of the emission path constituted by the residual flux of the emission laser beam not reflected by the cube MEL. This fraction is very small (a few percent for example) because the greater part of the laser flux is reflected towards the target. However, it is sufficient because the physical mechanism brought into play is very efficient. The conversion means MC are for example centered on an axis parallel to that of the emission laser beam FL incident in the cube MEL. These means MC are positioned in such a way that the entire part of the laser emission flux transmitted by the cube MEL and forming the excitation beam FE is collected.

The conversion means also comprise an optical assembly that enables the focusing of the excitation beam in the photoluminescent material and the collection of at least a part of the radiation sent to form a back-propagating beam FC, namely a beam that gets propagated collinearly with the excitation beam but in the reverse direction and having the same divergence. The optical assembly may be formed for example by a concave mirror 21 which is achromatic in the spectral band of the sensor of the observation path, the photoluminescent material referenced 22 being positioned in such a way that the excitation beam is focused inside the material. At the focusing point, the material isotropically emits a light wave in the spectral band of the sensor. A part of this flux is collected by the mirror and reflected so as to form the beam FC. Since the flux is emitted exactly at the focusing point, the back-propagating beam FC possesses the same optical characteristics of direction and divergence as the incident excitation beam and hence the emission laser beam. This is the property sought in the context of a harmonization system. In general, as shall be seen in the example chosen to illustrate FIGS. 1 and 2 and hereinafter in the description, the emission laser beam is substantially collimated and the excitation beam is a beam parallel to the emission laser beam. The beam resulting from the conversion is therefore collimated parallel to the excitation beam that gets propagated in reverse. The conversion means then behave as a cube corner which, associated with a cube MEL, enable a part of the beam FC resulting from the conversion to be sent back to the sensor DET of the observation path. The device according to the invention works also when the passive observation path and the laser emission path are separated not into collimated beams but into conversion beams. In this case, the excitation beam comes from a point at a finite distance. It is enough simply to have the right optical conjugation between the point from which the excitation beam comes and the photoluminescent material so that the beam (FC) resulting from the conversion is back-propagated from the excitation beam. The optical assembly of the conversion means may also contain dioptric elements (a focusing lens for example which may or may not be associated with a flux collection mirror). In any case, a simple optical assembly is sufficient. In particular, there is no need to position any delicate and bulky mechanical systems.

The part of the beam FC resulting from the conversion that is reflected to the sensor DET is weak because the mixing cube MEL is designed to let through the radiation emitted by the scene and detected by the observation path. However, the photoluminescence mechanisms are sufficiently effective for the detection of the part of the beam FC that is focused on the sensor.

According to one possible variant of implementation, the means MC are integrated into the optical sighting head VIS, i.e. they are fixedly joined to the elements composing it as shown in FIG. 2. Thus, for each position of the sighting head defined by the rotations ROT A and ROT B, a harmonization procedure is possible. This makes it possible to ascertain that the spot resulting from the photoluminescence on the detector DET of the passive path, which is characteristic of the optical axis of the laser emission path, is properly centered on the detected image. It must be noted that this spot can be very fine because, contrary to thermal mechanisms, there are no scattering effects in the photoluminescence mechanisms. Thus, the spot resulting from the photoluminescence has substantially the same diameter as the focusing spot of the excitation beam in the material. If necessary, it is possible to carry out the harmonizing proper, for example by centering the image on the photoluminescence spot by means of a fine adjustment of the rotations ROT A and ROT B. This harmonization procedure can be carried out in real time or by the pre-recording, before the images are acquired, of the positions of the spot corresponding to the optical axis of the laser as a function of the different positions of the sighting line. It is also possible, when one of the mirrors ML1 or ML2 is adjustable, to define a law of control of this mirror so that the optical axis of the beam is fixed in the image. This condition can be achieved for all the positions of the line of sight. It is also possible to identify the defects of harmonization so as to take account of them thereafter in the processing of the images required but without necessarily correcting them mechanically.

According to another variant, and when for example the total space available permits it, the conversion means MC may be fixed, not integrally joined to the sighting head in its motion, and centered in the same way as here above on the incident emission laser beam in the mixer. In this case, it is possible for example to correct the defects of harmonization due to biases introduced, during a mission, on the afocal lens. These biases would not be the same for the emission path and for the observation path.

The device according to the invention can also be used in an optronic system, for example a pod type system of target designation by laser guidance, in which the optical axes of the emission path and the passive path are distinct. An example of such a system is shown schematically in FIG. 3. In this example, each path has an afocal device, respectively referenced 31 for the laser path and 32 for the imaging path. The optical sighting head VIS comprising the elements of the laser and imaging paths is mobile for example in the rotations ROT A and ROT B as described here above. A part of the laser beam of the emission path is taken from the laser path by means of a dichroic plate 33 forming the excitation beam FE, and is then sent towards the conversion means MC. The beam FC resulting from the conversion and back-propagation of the beam FE is reflected partially by the plate 33 and then sent by means of a set of plates 34, 35 to the sensor DET of the passive observation path. The conversion means are for example fixed to the pod. In this case, the harmonization is done according to a single line of sight. The conversion means may be mobile in such a way that they can follow the motions of the sighting head, in rotations independent of the movements of the line of sight.

The very great variety of photoluminescent materials in terms of emission spectral band and luminescence lifetime make it possible to match the conversion means with the characteristics of the sensor of the passive observation path.

According to a first example, in the case of the harmonization of a laser path emitting 1.06 $\mu$m pulses of some tens of nanoseconds and a passive observation path sensitive in band 11 (about 3–5 $\mu$m), it is possible to use a photoluminescent material that is a solid material doped with photoluminescent ions?, for example a rare earth such as erbium. The erbium ions indeed emit towards 2.8 $\mu$m (detectable by the band 11 sensor) when they are excited at the 1.06 $\mu$m wavelength. FIG. 4 thus shows a possible implementation. The collimated excitation beam FE goes through the photoluminescent material 22 which takes the form of a plate with a thickness of about 1 millimeter, and is then focused by the mirror 21 in the material 22 in a focusing spot whose diameter is about 10 microns, thus creating high power density. At the focusing point, the plate isotropically emits a light wave whose wavelength is close to 2.8 $\mu$m. A part of the flux is collected by the mirror and collimated, thus forming the parallel beam FC which will be detected by the detector DEC of the imaging path. It must be noted that the flux not collected by the mirror is not inconvenient because it is highly defocused on the sensor of the imaging path and is therefore not detected. The configuration described here above has many advantages. In particular, the precision of setting the position of the photoluminescent material with respect to the mirror is easy to obtain because it is enough for the focusing point to be inside the plate. Furthermore, the device according to the invention is thus insensitive to thermal effects. This is because a modification of the temperature leads to a longitudinal shift of the focusing point which has no disturbing effect whatsoever as the focusing point remains within the material.

Thus, again taking the example of implementation described here above, with an excitation beam whose peak power is 100 W, photoluminescence power values of 1.2 $10^{-6}$ W may be emitted. This is sufficient for detection. Now the power values of the lasers of the emission paths in this type of target designation system are about 100 MW for pulse widths of 20 ns. In other words, the laser power taken in order to perform the harmonization function is almost negligible and will cause no deterioration whatsoever in the performance characteristics of the active section of the equipment. Furthermore, the photoluminescence lifetime of the erbium ions is great (more than 1 msec) and therefore far greater than the duration of the laser pulse itself. This means that erbium ions are a good wavelength transformer and also a good pulse duration transformer. This is particularly important when the sensor of the imaging path does not detect any short pulses. The exemplary embodiment described here may be extended to other ions (holmium, etc.) and other laser wavelengths to adapt the conversion means to the conversion requirement. Since the intensities of photoluminescence are great, it is also possible to cascade-connect the types of photoluminescent material to obtain the desired emission band if only one photoluminescent material does not meet all the criteria (see the example given hereinafter).

One alternative to the exemplary implementation of the conversion means described here above consists of the use of non-linear material with frequency conversion and a photoluminescent substance. Here, the interaction between the excitation beam FE and the non-linear beam generates a wave with a wavelength smaller than that of the excitation beam, and this wave can generate a photoluminescent emission of the luminescent substance. For example, it is possible to use a non-linear material doped with photoluminescent ions. A typical example is given by a lithium niobate (LiNbO3) crystal doped with erbium ions. Indeed, it is known that this rare earth has a photoluminescence emission close to 2.8 $\mu$m. On the contrary, the absorption coefficient is lower at 1.06 $\mu$m than it is at 0.5 $\mu$m. LiNbO3 has a second-order optical non-linearity. It is therefore possible to generate the second harmonic of 1.06 $\mu$m namely 0.532 $\mu$m. In this case, it is chiefly the wave at 0.532 $\mu$m that will excite the photoluminescence of the rare earth ion. To optimize interaction, it is possible to orient the crystal with respect to the incident excitation beam FE so as to verify the phase matching condition. One variant consists of the use of two separate materials, one to make the frequency conversion and the other to generate the photoluminescence in the desired band. It is then possible to optimize the two interactions separately.

Figure 5:
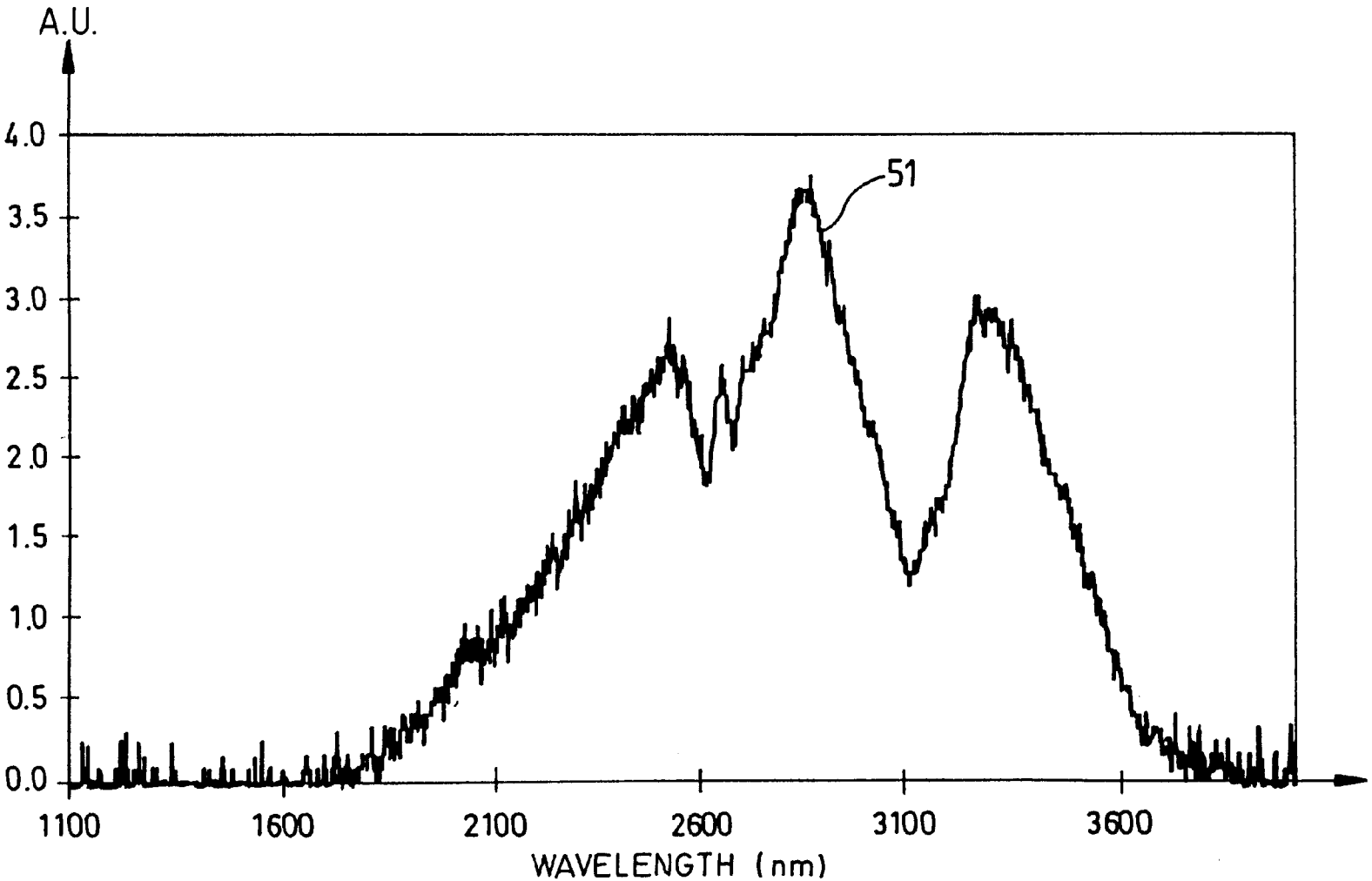
FIG. 5 shows a spectrum of emission of the photoluminescence of the semiconductor InAs.

In the configurations where the sensor of the observation path can detect short duration optical signals, it is advantageous to use a photoluminescent material that is a semiconductor material such as for example indium arsenide (InAs) or a more complex alloy to adapt the emission wavelength to the sensor. FIG. 5 shows the emission of photoluminescence (in arbitrary units or A.U.) as a function of the wavelength. The curve 51 thus represents an emission spectrum of the photoluminescence of InAs when it is excited by a Nd:YAG pulsed laser (with a pulse width of about 10 ns). The semiconductor may be used in massive form or in the form of a thin layer. Advantageously, as shown in FIG. 6, it may be used in the form of a patch 61 at the center of a transparent window 62 for the near infrared and infrared ranges. Indeed, since this material is highly absorbent at 1.06 $\mu$m, it is preferable that the excitation beam should not go through it before being focused for example by the mirror 21.

It is also possible to cascade different types of photoluminescent materials to obtain a desired emission band if a single photoluminescent material does not meet all the criteria. For example, by using the photoluminescence of a first substance that performs the main function of a pulse duration converter, it is possible to excite the photoluminescence of a second substance. For example, the first substance may be an erbium-doped material as described here above, namely a material which, when excited with a pulse laser at 1.06 $\mu$m, emits at around 2.8 $\mu$m with a lifetime of close to 1 millisecond. The second substance used may be a semiconductor material made in a thin layer or massive layer, absorbent at the 2.8 $\mu$m wavelength, whose composition is adjusted to emit exactly in the desired band. The first substance is used as a pulse duration converter and the second as a wavelength converter.

Figure 7:
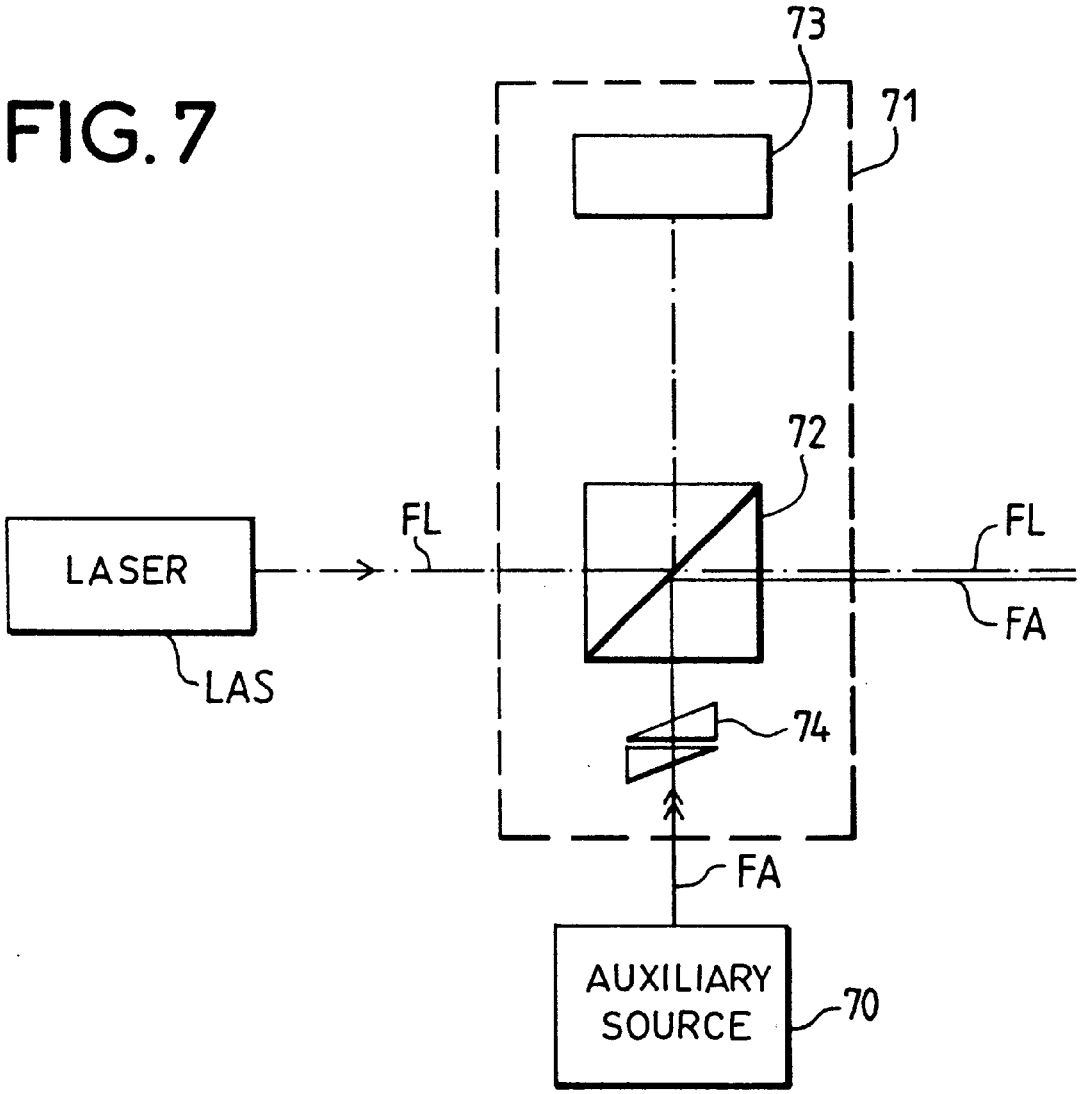
FIG. 7 is a partial drawing of an alternative embodiment of a device according to the invention.

One variant of the device according to the invention is described partially in FIG. 7. This variant entails the use of an auxiliary source 70 of the laser LAS of the emission path emitting a beam FA (in a solid line in FIG. 7) aligned by means of an alignment device 71 with a laser beam FL (in dots and dashes in FIG. 7). It is the beam FA that then forms the excitation beam FE that is incident to the conversion means along means identical to those described here above. Since the auxiliary source is independent of the emission laser, it may function with characteristics more favorable to the optimizing of the photoluminescence. For example, it may work in long pulses or continuously, the emission wavelength of the auxiliary source being close to that of the emission laser so that no excessively harsh constraints are placed on the alignment optical system of the two sources. Thus, an auxiliary source consisting of a semiconductor laser or a diode-pumped solid mini-laser emitting in the region of 1 $\mu$m may constitute the excitation beam of a photoluminescent material consisting for example of InAs type semiconductor as described here above. The constraint on the emission wavelength of the auxiliary source is that it should be shorter than the one corresponding to the forbidden gap of the semiconductor material used, when such a material is used.

In this case, it is vitally important to have perfect alignment between the emission laser beam LAS and the auxiliary source 70. For example, as shown in FIG. 7, the alignment device has a separator cube 72 whose separating surface is placed at 45° to the emission laser beam and to the beam coming from the auxiliary source, with an angular difference detector 73 receiving the two beams. This makes it possible, at any time, to check any angular difference between the two beams. Furthermore, it may also comprise a deflector assembly 74 made for example with a motorized diasporameter assembly capable of realigning the two beams under all conditions of use.

What is claimed is:

1. A device for harmonization between an emission path comprising a laser emitting an emission laser beam and a passive observation path comprising a sensor, the device comprising:

conversion means for converting an incident light beam into a back-propagating beam;

optical means for enabling the simultaneous sending, towards the emission path, of almost the totality of the emission laser beam and, towards the conversion means, of an excitation beam forming the incident beam and having a direction of propagation and divergence related to those of the emission laser beam; and means for sending the back-propagating beam to the sensor, thereby enabling real-time identification of defects of harmonization, wherein the conversion means comprises:

a photoluminescent material which, when excited at the wavelength of the excitation beam, emits a radiation whose wavelength is contained in the spectral band of the sensor, and an optical assembly enabling the excitation beam to be focused in the photoluminescent material and enabling the collection of at least a part of the emitted radiation to form the back-propagating beam.

2. A device according to claim 1, wherein with the emission laser beam being substantially collimated, the conversion means is configured to receive the substantially collimated excitation beam parallel to the emission laser beam and to return the back-propagating beam parallel to the excitation beam.

3. A device according to claim 1 or 2, wherein the photoluminescent material comprises a solid material doped with photoluminescent ions.

4. A device according to claim 3, wherein, with the wavelength of the excitation beam belonging to the visible/near infrared range of the spectrum, the photoluminescent ions are erbium ions.

5. A device according to claim 1 or 2, wherein the photoluminescent material comprises a non-linear material with frequency conversion and a photoluminescent substance, the interaction between the excitation beam and the non-linear material generating a wave having a wavelength below that of the excitation beam, said wave generating a photoluminescent emission of said photoluminescent substance.

6. A device according to claim 5, wherein, with the wavelength of the excitation beam being in the range of 1.06 $\mu$m and the photoluminescent substance comprising erbium ions, the non-linear material has a second-order linearity, the interaction between the excitation beam and the non-linear material resulting in a doubling of frequency.

7. A device according to one of the claims 1 or 2, wherein the photoluminescent material comprises a semiconductor material, the wavelength of the excitation beam being shorter than the wavelength corresponding to the forbidden gap of the semiconductor material.

8. A device according to claim 7, wherein the semiconductor is of the indium arsenide (InAs) type.

9. A device according to claim 1, wherein the photoluminescent material comprises two photoluminescent materials, including a first material being excited by the excitation beam to generate a photoluminescent beam and a second material being excited by the emission of the first material.

10. A device according to claim 9, wherein, with the excitation beam coming from a pulsed laser, the photoluminescence lifetime of the first material is greater than the pulse duration of said laser and the emission spectrum of photoluminescence of the second material at least partially covers the spectral band of sensitivity of the sensor of the observation path.

11. A device according to claim 1, wherein the excitation beam is a fraction of the emission laser beam of the emission path.

12. A device according to claim 1, further comprising:

an auxiliary source emitting an auxiliary beam; and a system for aligning said auxiliary beam with the emission laser beam of the laser emission path, wherein the excitation beam is a fraction of the auxiliary beam.

13. A system of target designation by laser guidance comprising:

an optical sighting head for the orientation of a line of sight comprising at least one afocal device for a laser emission path and a passive observation path comprising a detector;

means for correcting defects of harmonization between said laser emission path and said passive observation path; and a device for harmonizing the laser emission path and the passive path according to claim 1, wherein said defects of harmonization are corrected by the correction means.

14. A device for harmonizing a laser beam path with an observation path for a target, comprising:

a laser configured to generate a laser beam;

a first optical element configured to direct a first part of said laser beam toward said target along said laser beam path while directing a second part of said laser beam toward a conversion device; and a second optical element configured to direct a converted beam from said conversion device to a sensor configured to receive said converted beam and an image from said target;

wherein said conversion device comprises:

a photoluminescent material configured to convert said second part of said laser beam into a converted radiation having a wavelength within a spectral band of said sensor, and an optical assembly configured to focus said second part of said laser beam into said photoluminescent material and to collect at least a portion of the converted radiation to form said converted beam.

15. A device according to claim 14, wherein the conversion device is configured to direct said converted beam in a direction parallel to said second part of said laser beam.

16. A device according to claim 14, wherein the photoluminescent material comprises erbium ions.

17. A device according to claim 14, wherein the photoluminescent material comprises a semiconductor material having an energy gap corresponding to a wavelength longer than the wavelength of said laser beam.

18. A device according to claim 17, wherein the semiconductor material comprises indium arsenide.

19. A device according to claim 14, wherein the photoluminescent material comprises:

a first material configured to convert said second part of said laser beam into an intermediary radiation; and a second material configured to convert said intermediary radiation into said converted radiation.

20. A device according to claim 19 wherein:

said laser is configured to generate a pulsed laser beam having a pulse duration, the first material has a photoluminescence lifetime greater than said pulse duration, and the second material has an emission spectrum of photoluminescence covering at least a portion of a sensitivity spectral band of said sensor.

21. A device for harmonizing a laser beam path with an observation path for a target, comprising:

a laser configured to generate a laser beam;

a first optical element configured to direct a first part of said laser beam toward said target along said laser beam path while directing a second part of said laser beam toward a conversion device; and a second optical element configured to direct a converted beam from said conversion device to a sensor configured to receive said converted beam and an image from said target;

wherein said conversion device comprises:

a non-linear material configured to frequency convert said second part of said laser beam into an intermediary radiation having a wavelength shorter than said laser beam, a photoluminescent material configured to convert said intermediary radiation into a converted radiation having a wavelength within a spectral band of said sensor, and an optical assembly configured to focus said second part of said laser beam into said photoluminescent material and to collect at least a portion of the converted radiation to form said converted beam.

22. A device according to claim 21, wherein:

the laser beam has a wavelength of 1.06 $\mu$m, the non-linear material is configured to double the frequency of said laser beam, and the photoluminescent substance comprises erbium ions.

23. A device for harmonizing a laser beam path with an observation path for a target, comprising:

a laser configured to generate a laser beam;

an auxiliary source configured to emit an auxiliary beam;

an alignment system configured to align said auxiliary beam with said laser beam;

a first optical element configured to direct said laser beam toward said target along said laser beam path and to direct at least a portion of said auxiliary beam toward a conversion device;

a second optical element configured to direct a converted beam from said conversion device to a sensor configured to receive said converted beam and an image from said target;

wherein said conversion device comprises:

a photoluminescent material configured to convert said portion of said auxiliary beam into a converted radiation having a wavelength within a spectral band of said sensor, and an optical assembly configured to focus said portion of said auxiliary beam into said photoluminescent material and to collect at least a portion of the converted radiation to form said converted beam.

* * * * *